United States Patent [19]

Smith

[11] 3,933,131

[45] Jan. 20, 1976

[54] ROTARY ENGINE

[76] Inventor: Russel I. Smith, 668 Rochdale Circle, Lombard, Ill. 60148

[22] Filed: July 12, 1974

[21] Appl. No.: 488,025

Related U.S. Application Data

[63] Continuation-in-part of Ser. No. 388,629, Aug. 15, 1973, abandoned.

[52] U.S. Cl. ..... 123/8.47; 418/33

[51] Int. Cl.[2] ..... F02B 53/00

[58] Field of Search ..... 123/8.47; 418/33–38, 101

[56] References Cited

UNITED STATES PATENTS

| | | | |
|---|---|---|---|
| 1,712,945 | 5/1929 | Thannhauser | 418/101 |
| 1,793,875 | 2/1931 | Staaf | 418/38 |
| 1,839,275 | 1/1932 | Sweningson | 123/8.47 |
| 2,737,161 | 3/1956 | Gaskell | 418/36 |
| 3,139,871 | 7/1964 | Larpent | 418/36 |
| 3,144,007 | 8/1964 | Kauertz | 418/36 |
| 3,363,606 | 1/1968 | Robertson | 123/8.47 |
| 3,824,963 | 7/1974 | Eda | 123/8.47 |

*Primary Examiner*—C. J. Husar
*Assistant Examiner*—O. T. Sessions
*Attorney, Agent, or Firm*—Roger A. Schmiege

[57] ABSTRACT

A rotary engine including a pair of concentric rotors one being rotatable within the other, one of said rotors being driven by the output shaft of the engine and the other rotor connected to drive said output shaft. The outer rotor having radially inwardly extending abutments and the inner rotor having radially outwardly extending abutments, the abutments of the two rotors defining therebetween a plurality of expansible gas chambers. The inner rotor having means to hold same stationary so as to provide a reaction member for said outer rotor and intermittent drive means driven by said output shaft and adapted to intermittently drive said inner rotor to create relative rotation between said rotors whereby expansion and contraction of said chambers will take place.

9 Claims, 14 Drawing Figures

10
12
14
16
18
20
22
24
26
28
30
32
34
36
38
40
42
44
46
48
50
52
60
62
64
70
72
74
76
78
80
82
90
92
94
96
98
102
104
130
154
T-2
T-3
T-4
T-5
T-6
L-2
L-3
L-4
L-5
L-6

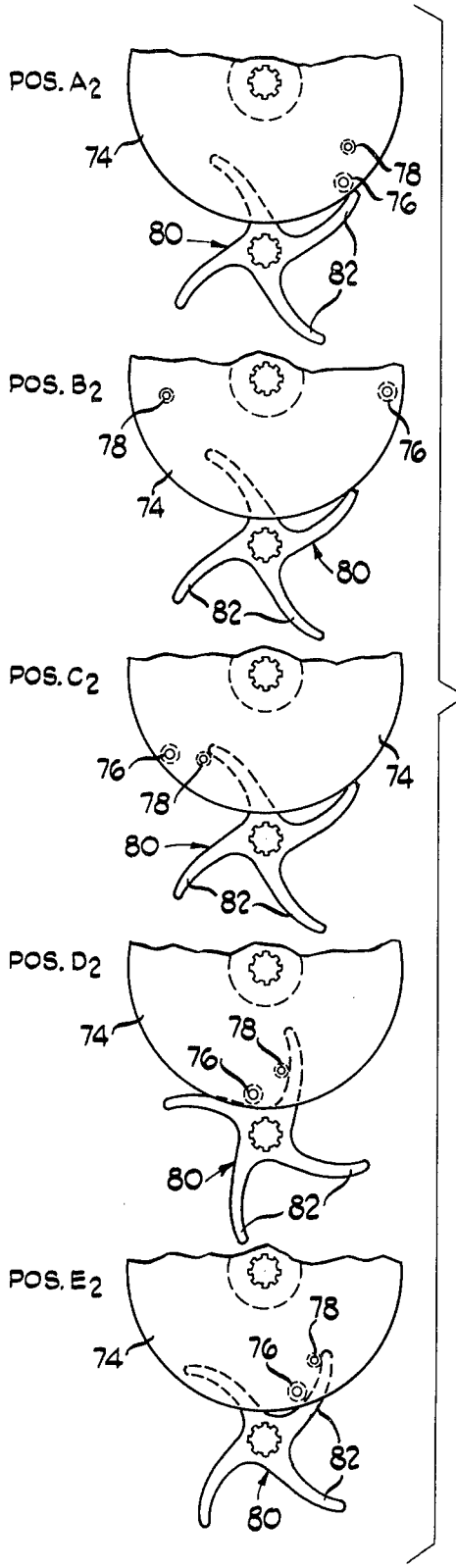
Fig 8
Fig 9A
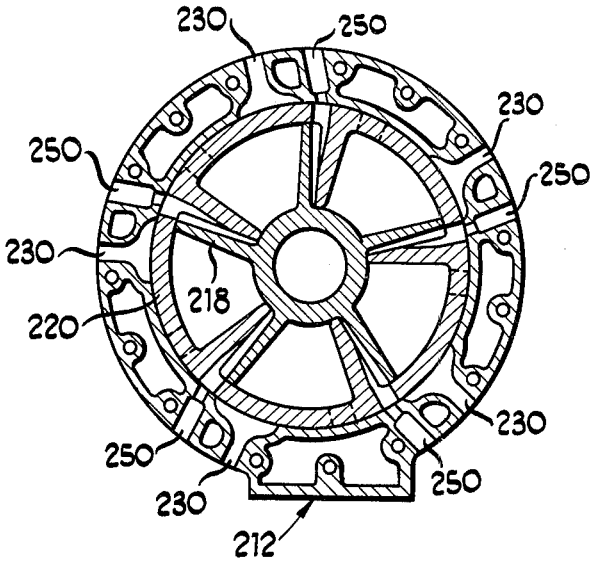
Fig 9B
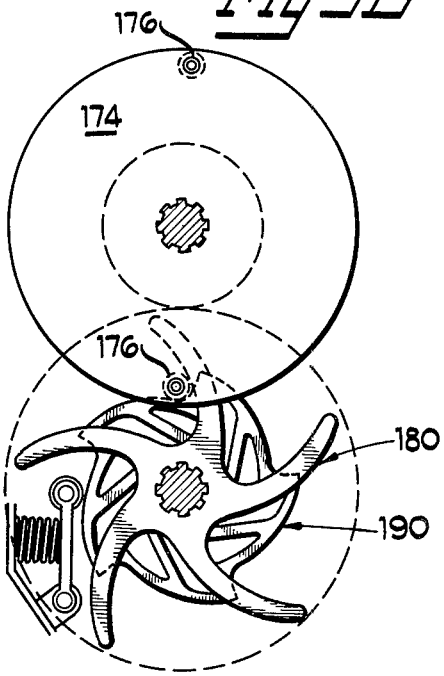

ROTARY ENGINE

CROSS REFERENCE TO RELATED APPLICATIONS

This application is a continuation-in-part of application Ser. No. 388,629, filed Aug. 15, 1973 and now abandoned.

SUMMARY OF THE INVENTION

The present invention provides an improved form of rotary engine which may be of any expanding gas type such as an internal or an external combustion engine. The unique design of the present invention includes a design of inner and outer rotors between which four expansible gas chambers are provided whereby two power expansion phases occur simultaneously in a balanced manner on opposite sides of the engine for each 90° of rotation of the rotors.

An improved form of intermittent drive mechanism is provided adapted to drive the inner rotor at a relative rotation with respect to the outer rotor to create expansion and contraction of the gas chambers, by starting the rotation of the inner rotor slowly, moving it faster and then stopping the rotation abruptly as the inner rotor is about to catch up with the outer rotor.

The invention further includes a fan driven by the output shaft which is adapted to force air through the internal engine parts to provide improved cooling for the engine.

Further, a unique checking mechanism is provided which will operate to hold the inner rotor stationary to act as a reaction member when combustion takes place in the gas chamber.

DESCRIPTION OF THE DRAWINGS

The preferred form of the present invention is illustrated in the accompanying drawings wherein:

FIG. 8 is a schematic view illustrating positions of the intermittent drive machanism during operation of the engine;

FIG. 9A is a cross-section view of rotors and associated ports in a modified form of the invention for a five chamber external combustion engine;

FIG. 9B is an end view of the intermittent drive mechanism for the modification of FIG. 9A;

Referring to FIG. 1, a cross-sectional view of a rotary engine is shown including a casing 12, an output shaft 14, a rotor shaft 16, a pair of internal rotors 18 and a pair of external rotors 20.

Figures 1, 2:
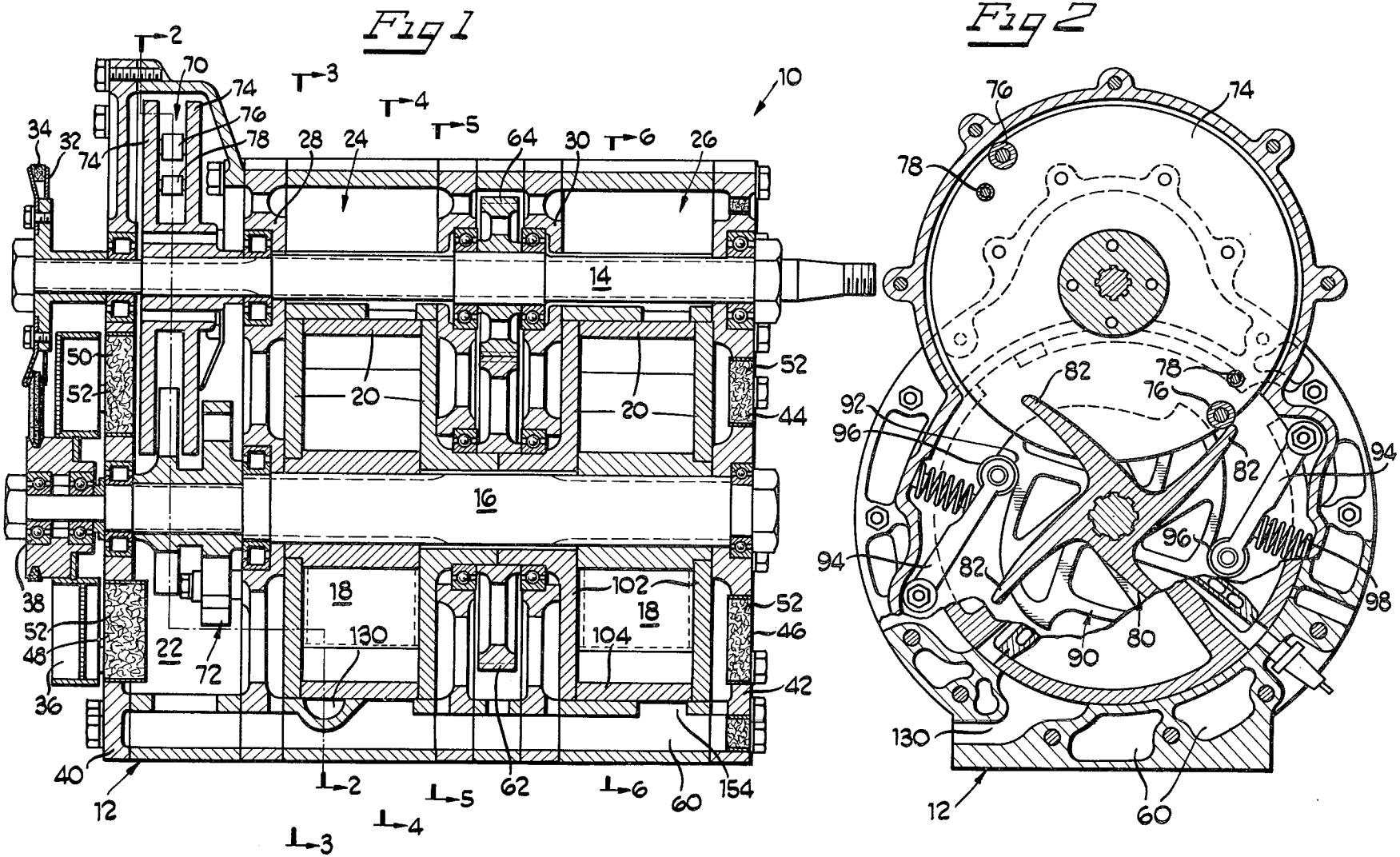
FIG. 1 is a cross-sectional view through a rotary engine incorporating the principles of the present invention.
FIG. 2 is a sectional view taken along the lines 2—2 of FIG. 1.
Figure 3:
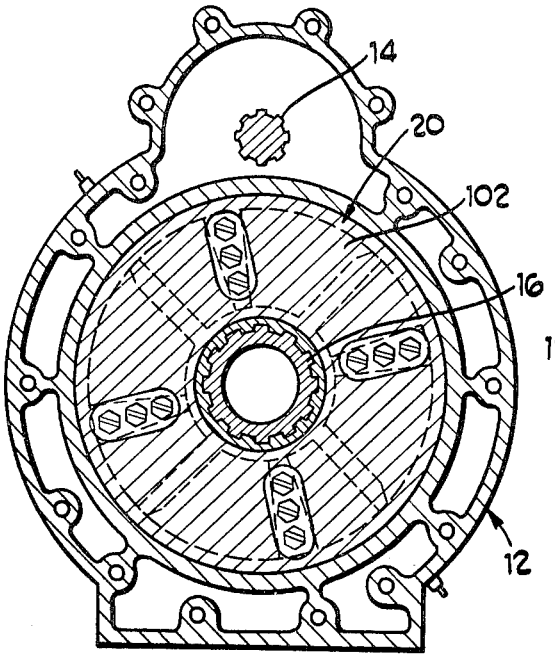
FIG. 3 is a view taken along the lines 3—3 of FIG. 1.

The engine casing 12 for the present two section rotary engine illustrated includes a compartment 22, a compartment 24 and a compartment 26, a partition 28 separates compartments 22 and 24. The output shaft 14 drives a pulley 32 which by means of a belt 34 drives a cooling fan 36 rotatably journalled on rotor shaft 16 by bearings 38.

The casing 12 has end walls 40 and 42. The end wall 42 has air ports 44 and 46 therein and the end wall 40 has air ports 48 and 50. Each of the air ports has disposed therein by friction fit, air filter material 52 which may be of any known type. Suitable openings are provided in each of the partitions 28 and 30 to allow air flow therethrough and large air passages 60 are provided in the casing to provide for air flow. As will be apparent, the fan will draw the air into ports 48 and 50 of end wall 40 and the air will flow through the various parts of the engine and out through ports 44 and 46 in end wall 42.

As seen in FIG. 1, outer rotors 20 are drivingly connected as for example by splines to a gear 62 which in turn drives a small gear 64 which is drivingly connected to output shaft 14. Referring to FIG. 1 and 2, the compartment 22 contains an intermittent drive mechanism 70 and a brake mechanism 72. The drive mechanism 70 includes a pair of discs 74 having a pair of large rollers 76 and small rollers 78 mounted therebetween on opposite sides of the discs 74. Provided on rotor shaft 16 is a cam 80 having four arms 82 thereon adapted to be driven by the rollers 76 and 78 of the drive mechanism 70.

The brake mechanism 72 which comprises a one-way brake preventing counter clock-wise rotation of shaft 16 as illustrated in FIG. 2 includes a four lobe cam 90. The lobes have reaction or brake surfaces 92 thereon. A pair of brake arms 94 are provided on opposite sides of the cam 90 which are pivoted to the casing 12. A roller 96 is provided on a free end on each of the arms 94. Springs 98 are provided engaging each of the arms 94. Springs 98 are provided engaging each of the arms 94 and urging the arms toward the cam 90 to keep rollers 96 engaged with the cam.

Figure 4:
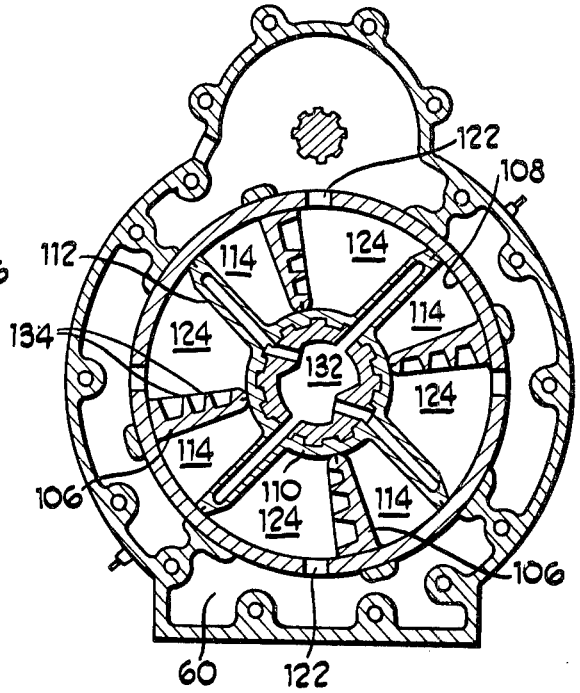
FIG. 4 is a view taken along the lines 4—4 of FIG. 1.
Figure 5:
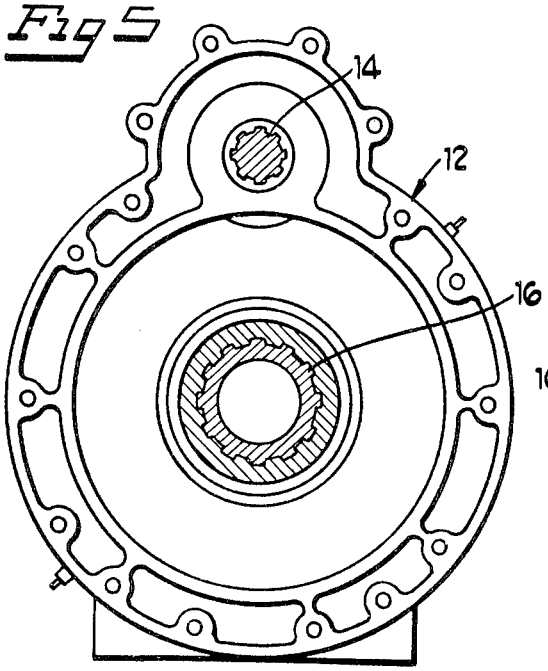
FIG. 5 is a view taken along the lines 5—5 of FIG. 1.
Figure 6:
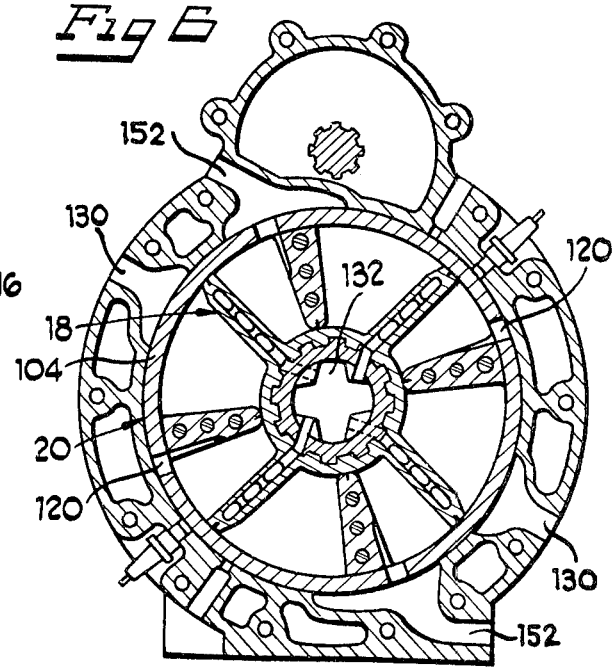
FIG. 6 is a view taken along the lines 6—6 of FIG. 1.

Referring to FIGS. 4 and 6, the structure of the outer and inner rotors 18 and 20 is illustrated. As viewed in FIG. 1, the outer rotors 20 have vertical side walls 102 and an outer circular wall 104 within which the inner rotor 18 is confined. The outer rotor has in addition four radially inwardly extending abutments 106 and an inner circular sealing surface 108. The inner rotor 18 has a central hub 110 having mounted thereon four radially outwardly extending hollow arms 112 which act as pistons and reaction members. Arms 112, arms 106, surface 108 and hub 110 define four combustion chambers 114 surrounding the rotary shaft 16.

Ports 120 are provided in the cylindrical wall 104 of the rotor 20 to admit fuel and air to chambers 114 and to allow escape of exhaust gases therefrom. Ports 122 are provided to admit air into each of four air chambers 124 which are defined between rotors 18 and 20 on the opposite sides of arms 112 from chambers 114. A pair of exhaust ports 130 on opposite sides of the engine are shown in FIG. 6 which by means of ports 120 will allow escape of exhaust gases. The rotary shaft 16 is hollow as illustrated at 132 to allow a coolant to circulate through the hollow arms 112. In addition fins 134 are provided on arms 106 of rotor 20, the fins being in contact with air chambers 124 whereby the engine may be adequately cooled.

Figure 7:
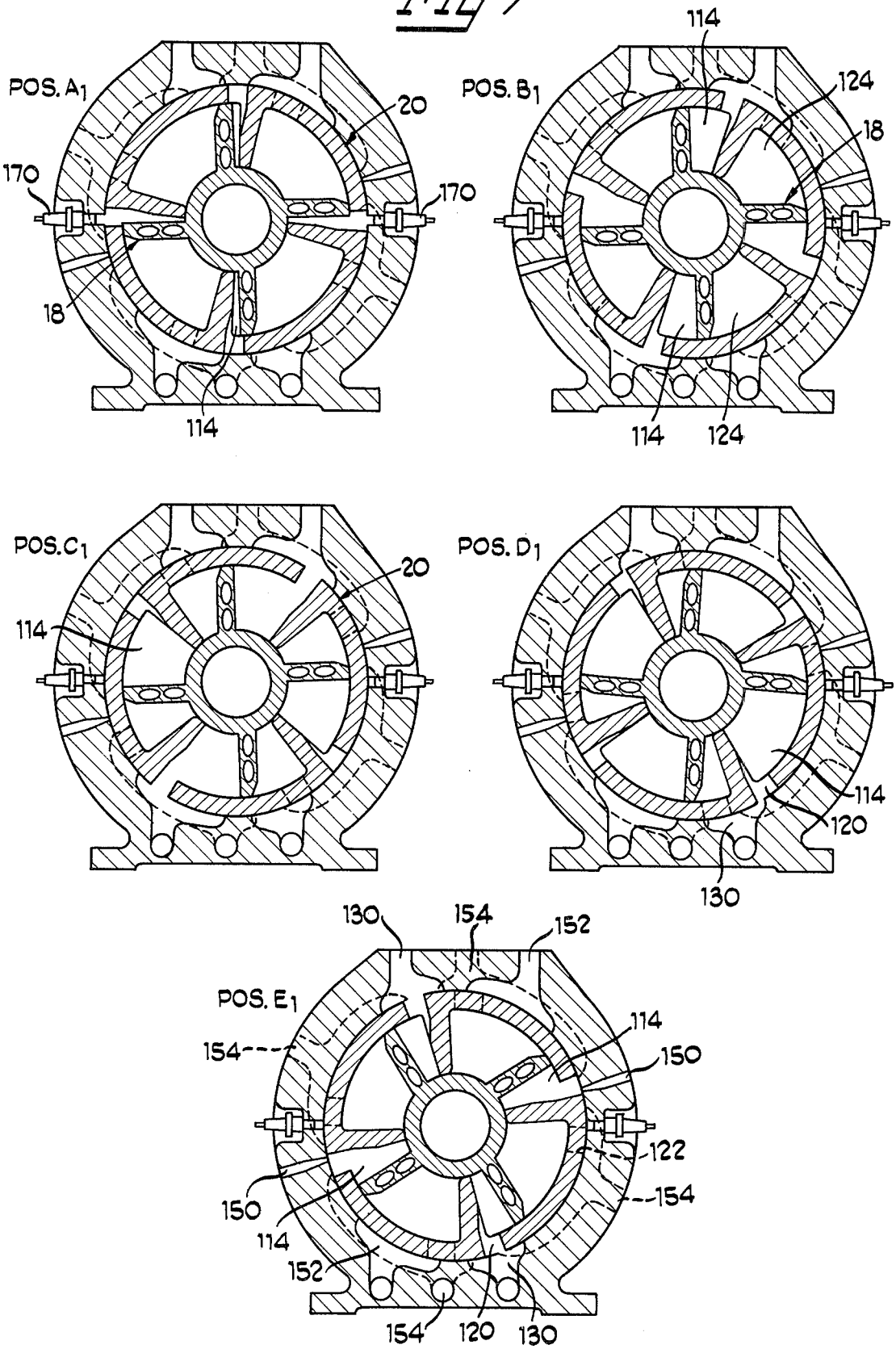
FIG. 7 is a schematic view illustrating various positions of the inner and outer rotors of the engine during operation.

Referring to FIG. 7, the porting arrangement for the engine is best illustrated showing exhaust ports 130, fuel injection ports 150 on opposite sides of the engine, the combustion air ports 152 on opposite sides of the engine, and four air cooling ports 154 in the casing 12 disposed around the rotors. The air coolant ports 154 are in communication with ports 122 of rotor 20 and the combustion air ports 152 are in communication with ports 120 of rotor 20. A pair of spark plugs 170 are provided on opposite sides of the engine as viewed in FIG. 7 near fuel injection ports 150.

Referring to FIGS. 9A and 9B, the views of the rotors and intermittent locking mechanism show five abutments on each rotor of an external combution engine which also has five compressed gas ports 250, five exhaust ports 230, a five-armed cam 180 to drive the intermittent rotor, a five lobed cam 190 to prevent backward rotation, and drive mechanism discs 174 supporting two single rollers 176. A six chambered rotor would use a six-armed cam and drive mechanism supporting three single rollers.

Operation of the Device

Referring to FIGS. 7 and 8, the operation of the engine 10 is best illustrated. Referring to FIG. 7 in position A, spark plugs 170 have just fired whereby the gas within chambers 114 on opposite sides of the engine expand driving outer rotor 20 toward the position illustrated in position $B_1$. The inner rotor 18 remains stationary since reaction forces during the combustion will be held by the rollers 96 acting on surfaces 92 of cam 90 to prevent counter-clockwise rotation of inner rotor 18. In position A, the chambers 114 at the upper and lower parts of the engine have just completed the exhaust of previously burned gases. In position $B_1$ as illustrated in the upper and lower sections, the chambers 114 at top and bottom are now expanding taking in combustion air through ports 152. In position $B_1$, rotor 18 remains stationary.

In position $C_1$ rotor 20 has continued to rotate clockwise creating the maximum volume of chambers 114 to completely fill the chambers with air and exhaust gasses. The inner rotor 18 is still stationary in position $C_1$. Relating FIG. 8 to FIG. 7, it can be seen that due to the position of driving rollers 76 and 78 the cam 80 remains stationary in positions A, B and C but beginning with Position $C_2$ the roller 78 engages an arm 82 and begins to drive the cam 80. In position D of FIG. 7, the drive means 70 is illustrated as beginning to drive rotor 18. Rotor 18 begins to catch up with rotor 20 and thus begins to compress the air in two of the chambers 114 by reducing the volume of chambers 114. As shown in position E, the chambers 114 on opposite sides now approaching the spark plugs 170 are in communication with fuel injection ports 150 through ports 120 and fuel is injected into same. When the parts reach the positions as illustrated in position A, the chambers 114 in communication with spark plugs 170 are at minumum volume condition charges with compressed air and fuel ready for combustion. The above cycle will be repeated as the spark plugs ignite the fuel in chambers 114.

It should be noted that chambers 124 during the above cycles also expand and contract thus taking in and expelling cooling air to help cool the engine.

The external combustion engine is driven by compressed gas which is vented from an external chamber through the ports 250 into the rotor chambers 114 where it forces the constantly moving rotor to rotate by pressing in a tangential manner on the abutments of this rotor, thus having a considerable advantage in efficiency over the inefficient reciprocating engine.

In the external combustion engine, no ignition plugs are used, there are no intake or compression phases, and there are twenty-five power pulses (phases) in each engine revolution.

Referring to FIGS. 10, 11, 12A and 12B, modified forms of intermittent drive and holding mechanisms are illustrated with parts thereof identical to those of FIGS. 1 and 2 carrying the same numerical designations.

Figure 10:
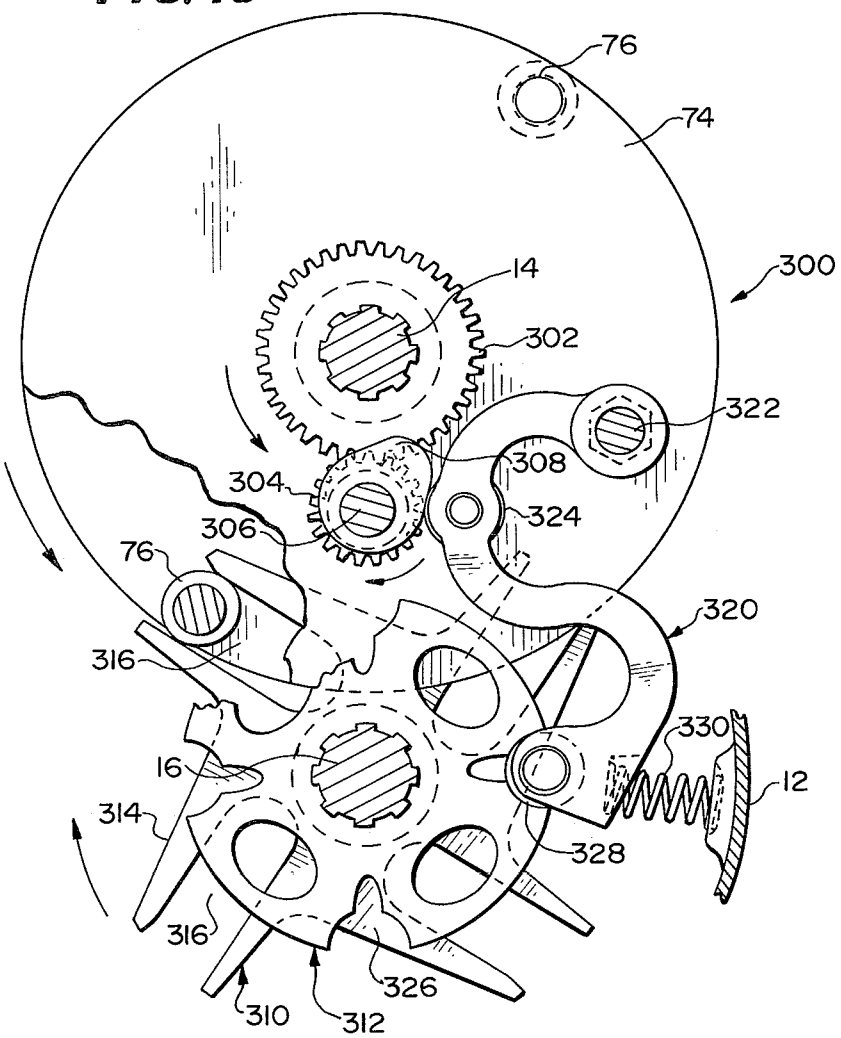
FIG. 10 is an end view of a modified form of intermittent drive and holding mechanism.

Referring specifically to FIG. 10 the drive and holding mechanism 300 includes a gear 302 driven by shaft 14. Gear 302 in turn engages a gear 304 mounted on a shaft 306. A cam 308 is attached to gear 304 to be driven thereby.

Drivingly connected to shaft 16 by splines is a driving cam 310 and a brake or holding cam 312. Drive cam 310 has four arms 314 each having a slot 316 therein. Slots 316 are sized to receive drive rollers 76 as they travel on rotating disc 74.

A brake or holding mechanism is provided for intermittently holding shaft 16 during periods when shaft 16 is not being driven by rollers 76 as in the embodiement of FIGS. 1 and 2. The brake mechanism includes a brake arm 320 pivotally mounted on a pin 322 attached to casing 12. Arm 320 carries a follower roller 324 in engagement with cam 308. The brake cam 312 has four holding grooves 326 formed therein. Brake arm 320 carries a holding roller 328 thereon which is adapted to engage in grooves 326. A spring 330 engages arm 320 and urges same to pivot about pin 322 and engage roller 328 in one of the grooves 326. It will be seen that cam 308 is properly positioned to pivot arm 320 counter-clockwise about pin 322 through roller 324 to disengage roller 328 from one of the grooves 326 at the same time as one of the rollers 76 moves into a slot 316 and begins to drive shaft 16. When shaft 16 has been driven through the appropriate degrees of rotation and roller 76 begins to leave slot 316 the cam 308 will be timed to allow spring 330 to pivot arm 320 to re-engage roller 328 with one of the grooves 326 to hold shaft 16.

Figure 11:
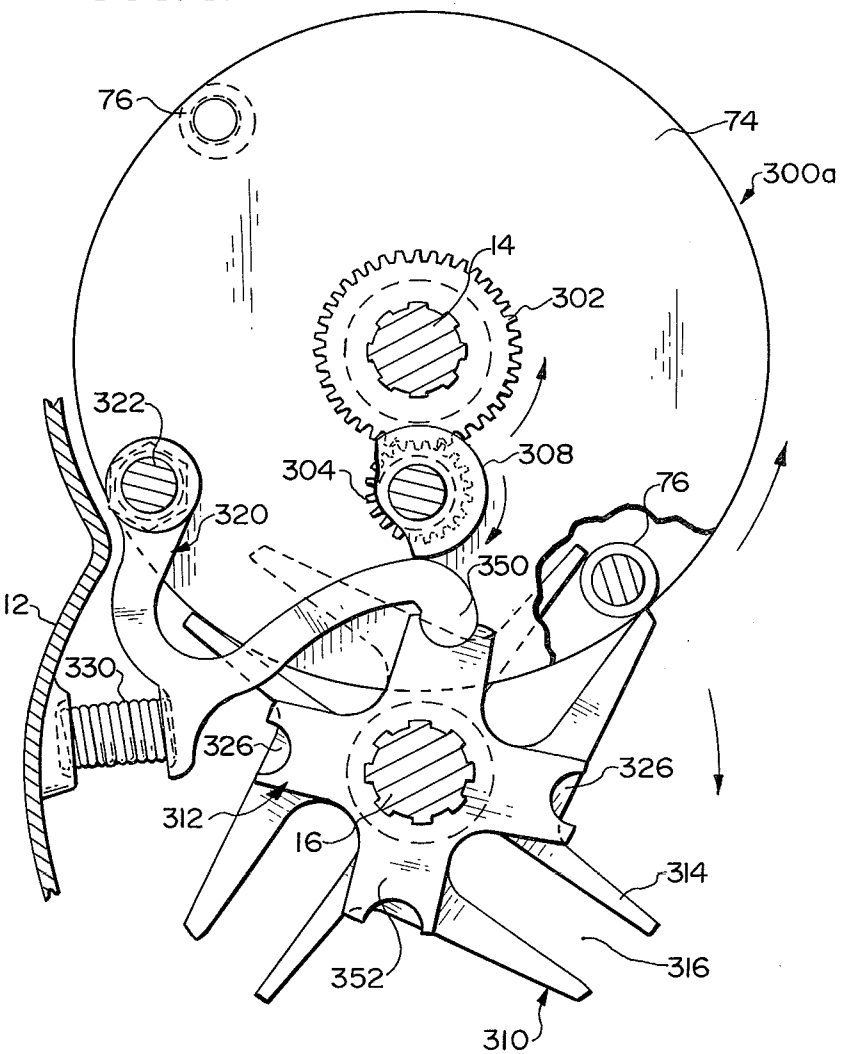
FIG. 11 is an end view of a further modified form of intermittent drive and holding mechanism.

Referring to FIG. 11, an intermittent drive and holding mechanism **300*a* is shown which is very similar to mechanism 300 of FIG. 10 and like elements carry identical numbers to those of FIG. 10. Brake arm 320 is modified and has a curved end 350 thereon adapted to engage in holding grooves 326 to hold shaft 16. Holding cam 312 in FIG. 11 has four arms 352 thereon each having a groove 326 therein. The device of FIG. 11 works in a similar manner to that of FIG. 10**.

Figure 12:
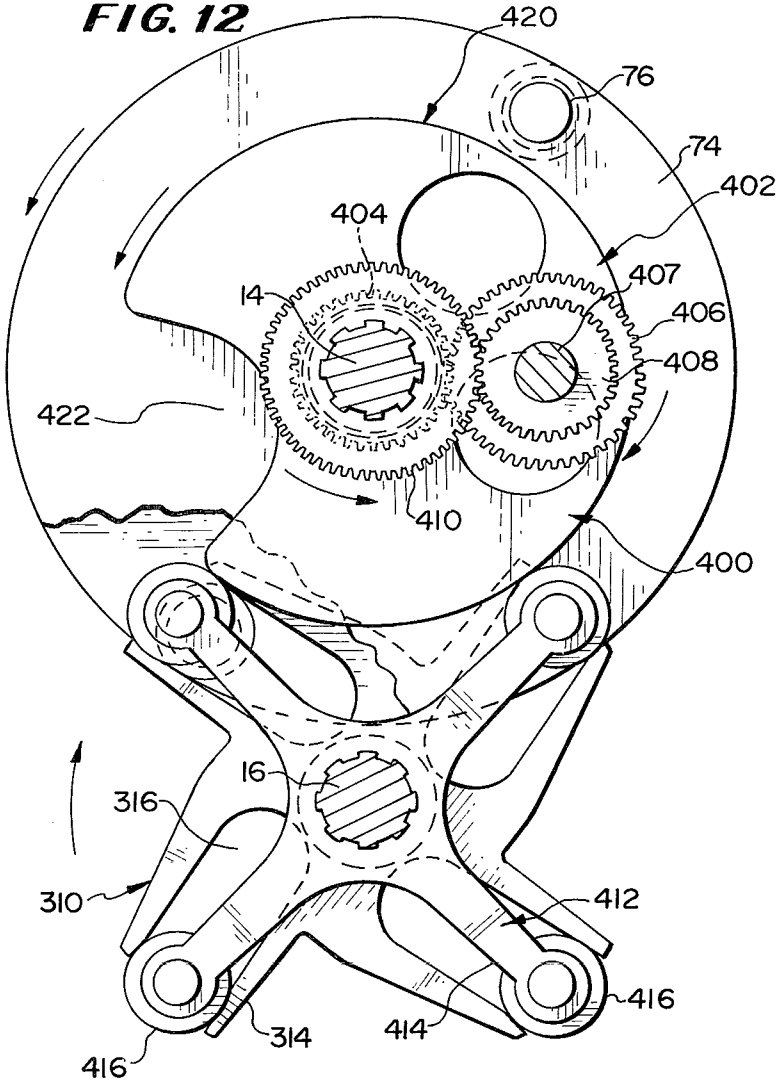
FIG. 12 is an end view of another modified form of intermittent drive mechanism.

Referring to FIG. 12 another modified form of holding mechanism is shown. The drive mchanism of FIG. 12 is identical to that of FIGS. 10 and 11 using rollers 76 to drive cam 310 by engagement of slots 316. The holding mechanism of FIG. 12 includes a large cam 400 which is adapted to be driven by a gear train 402 at twice the speed of shaft 14. Gear train 402 includes a gear 410 driven by shaft 14 or disc 74 which engages a smaller gear 408 mounted on a stationary pin 407. Gear 408 drives a larger gear 406 also mounted on pin 407. Gear 406 is in mesh with gear 404. Gear 404 drives cam 400 at twice the speed of shaft 74 cam 400 being rotatably mounted on shaft 14. The holding cam 412 in this case includes four arms 414, each arm having a roller 416 mounted on the end thereof. Cam 400 has a peripheral cam surface 420 thereon having a notched or indented portion 422. It will be seen that as large cam 400 rotates when the notched portion 422 is near one of the rollers 416 as the parts rotate, the shaft 16 can rotate. However, when notched portion is positioned such that two of the rollers 416 engaged peripheral surface 420, shaft 16 will be unable to moved and is thus held intermittently as in the other embodiments.

Figure 13:
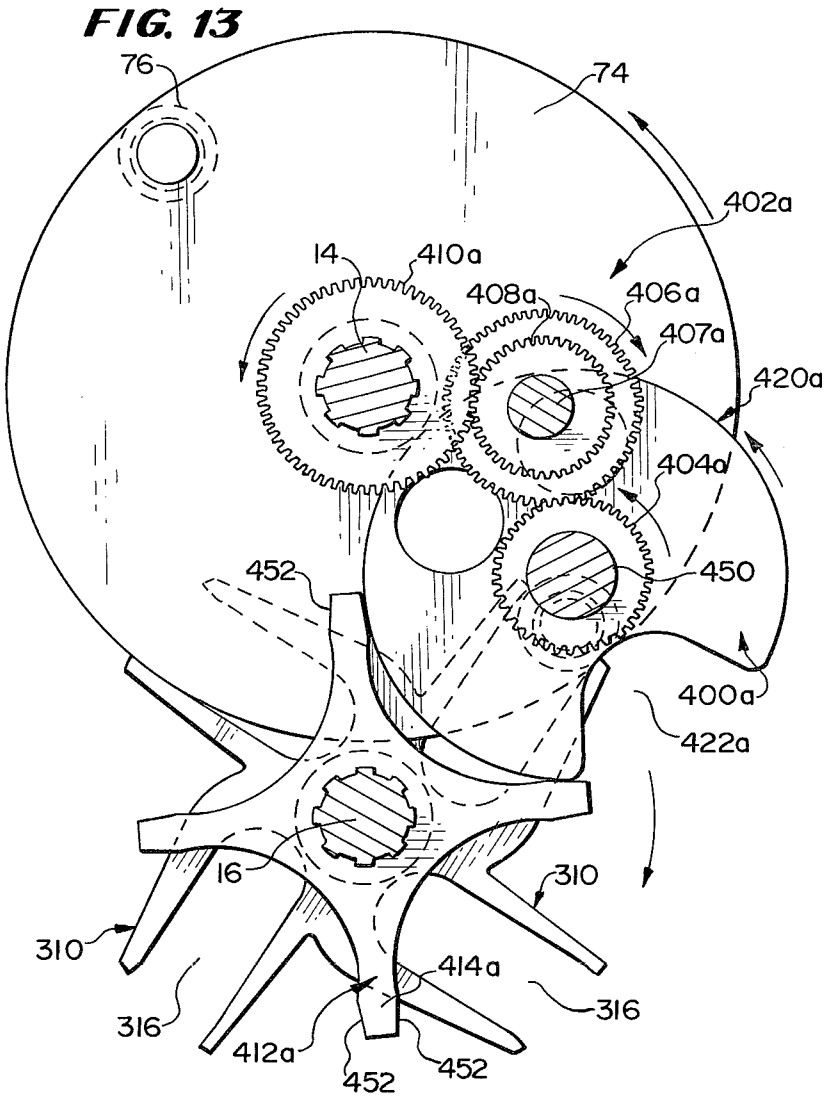
FIG. 13 is a modified form of the mechanism of FIG. 12.

Referring to FIG. 13 is a modified form of holding mechanism similar to that of FIG. 12 is shown. The mechanism of FIG. 13 includes a cam 400*a* rotatably mounted on pin 450 mounted in casing 12. Gear 404*a* is similar to gear 404 of FIG. 12 except gear 404*a* is mounted on the pin 450 rather than on shaft 14. As in the case of FIG. 12, the gear train 402*a* drives cam 400*a* at twice the speed of disc 74 or shaft 14. Cam 400*a* has a peripheral surface 420*a* which is notched or indented at 422*a*. Holding cam 412*a* includes four arms 414*a* having engaging surfaces 452 which are adapted to engaged peripheral surface 420*a* (as viewed in FIG. 13) whereby shaft 16 is unable to rotate. As in the FIG. 13 embodiment, when one of the arms 412*a* is in the area of notch 422*a* the shaft 16 is free to be rotated through the medium of rollers 76 engaging slots 316 on drive cam 310.

Having described various embodiments of the invention, various other modifications will now become apparent to those skilled in the art within the scope of the apended claims.

I claim:

1. A rotary engine comprising a casing, a rotatable output shaft mounted in said casing, a rotatable rotor shaft mounted in said casing, a pair of concentric rotors comprising an intermittently rotating and constantly rotating rotor in said casing, said intermittently rotating rotor connected to be driven by said rotor shaft, said constantly rotating rotor being drivingly connected to said output shaft and partly defining at least two rotary internal gas expansion chambers, the intermittently rotating rotor being disposed wholly within said constantly rotating rotor and having at least one reaction element thereon disposed within said internal chamber, said rotors both rotating about the axis of said rotor shaft, intermittent drive means connected between said output shaft and said rotor shaft and adapted to intermittently drive said rotor shaft and thereby said intermittently rotating rotor, separate reaction brake means connected to said rotor shaft, said reaction brake means adapted to hold said rotor shaft stationary to provide a reaction for said intermittently rotating rotor whereby when gas expands within said internal chamber said constantly rotating rotor will be driven to drive said output shaft, said brake means comprising cam means formed on said rotor shaft engaged by pivoted followers which permit only one way rotation of said rotor, a driving cam having arms thereon connected to said rotor shaft, a rotary member having a plurality of driving means thereon and driven by said output shaft, said driving means adapted to intermittently engage said driving cam arms to provide for intermittent drive of said rotor shaft, said driving means having two or more roller pairs, which roller pairs successively engage with an arm of the driving cam and thereby move said driving cam to start up slowly and then to stop abruptly as the inner rotor is about to catch up with the outer rotor.

2. A rotary engine as defined in claim 1 wherein spring means are provided in contact with said followers and yieldably urging said followers into engagement with said cam means.

3. A rotary engine as claimed in claim 1 wherein said casing includes air passage means therein, said rotor shaft having a fan rotatably mounted thereon, said fan connected to be driven by said output shaft and adapted to push air through said casing to cool said engine.

4. A rotary engine as claimed in claim 1 wherein said reaction means on said intermittent rotor comprises radially extending abutment members which have relative rotation with respect to said one constantly moving rotor to provide for expansion and contraction of said internal gas chamber during operation of said rotary engine.

5. A rotary engine as claimed in claim 4 wherein means are provided to inject fuel into said chamber and including ignition plug means adapted to ignite the fuel in said chamber whereby said one rotor will be driven by the combustion of said fuel in said chamber.

6. A rotary engine as claimed in claim 5 including varying volume cooling chambers and displaced from said internal chambers, and means admitting air to said cooling chambers to cool said engine.

7. A rotary engine as claimed in claim 6 wherein said means to admit fuel and air are radially disposed with respect to said rotors and external thereto.

8. A rotary engine as claimed in claim 4 wherein a plurality of ports are provided in said casing, certain of said ports venting externally compressed gas into the rotary chambers, certain of said ports directing compressed gas into chambers of constantly changing volume, and certain of said ports directing compressed gas intermittently and at a slight angle toward the abutments of the constantly rotating rotor.

9. A rotary engine as claimed in claim 8 wherein the radially extending abutment members of the inner rotor are made hollow and are kept cool by conducting a coolant through holes in the abutment members.

* * * * *